US006672632B1

(12) United States Patent
Speed et al.

(10) Patent No.: US 6,672,632 B1
(45) Date of Patent: Jan. 6, 2004

(54) MORTISE LOCK

(76) Inventors: Daryl F. Speed, 2910 W 3rd Ave., Vancouver, B.C. (CA), V6K 1M7; Christopher D. Isfeld, 36081 Regal Park Way, Abbotsford, B.C. (CA), V3G 1L1; Mark Rees-Howlett, 34845 Cooper Place, Abbotsford, B.C. (CA), V2S 7K6; Brent A. Foster, 2412 Mountain Dr., Abbotsford, B.C. (CA), V3G 1E7

( * ) Notice: Subject to any disclaimer, the term of this patent is extended or adjusted under 35 U.S.C. 154(b) by 0 days.

(21) Appl. No.: 10/252,925

(22) Filed: Sep. 24, 2002

(51) Int. Cl.[7] ..... E05C 9/10

(52) U.S. Cl. ..... 292/25; 292/26; 292/7; 292/11; 292/DIG. 60; 292/DIG. 46

(58) Field of Search ..... 292/5, 6, 7, 11, 292/26, 25, 48, 109, 110, DIG. 60

(56) References Cited

U.S. PATENT DOCUMENTS

| | | | | | |
|---|---|---|---|---|---|
| 1,269,311 | A | * | 6/1918 | Rixson | 292/36 |
| 1,716,113 | A | * | 6/1929 | Carlson | 24/68 TT |
| 1,794,786 | A | * | 3/1931 | McBride et al. | 292/48 |
| 1,929,370 | A | * | 10/1933 | Hamilton | 292/48 |
| 2,285,301 | A | * | 6/1942 | Nelzon | 292/126 |
| 2,670,980 | A | * | 3/1954 | Milhoan | 292/7 |
| 3,054,484 | A | * | 9/1962 | Griffiths et al. | 403/317 |
| 3,342,516 | A | * | 9/1967 | Morand | 292/6 |
| 3,586,360 | A | * | 6/1971 | Perrotta | 292/26 |
| 4,362,328 | A | * | 12/1982 | Tacheny et al. | 292/36 |
| 4,643,005 | A | | 2/1987 | Logas | |
| 5,125,703 | A | | 6/1992 | Clancy et al. | |
| 5,437,484 | A | * | 8/1995 | Yamada | 292/36 |
| 5,526,659 | A | | 6/1996 | Takimoto | |
| 5,820,170 | A | * | 10/1998 | Clancy | 292/26 |
| 5,951,068 | A | * | 9/1999 | Strong et al. | 292/39 |
| 6,502,435 | B2 | * | 1/2003 | Watts et al. | 70/95 |

* cited by examiner

*Primary Examiner*—Robert J. Sandy
*Assistant Examiner*—Dinesh Melwani
(74) *Attorney, Agent, or Firm*—Frederick Kaufman

(57) ABSTRACT

The device comprises a housing encasing a pair of upper and lower hooks, for counter-rotational movements; a pair of upper and lower adjusting assemblies, vertically spaced in parallel with the pair of upper and lower hooks for positioning the latter within the housing; an actuating assembly including a double-armed pivot having a cylindrical body and a pair of radially extending arms, disposed between the pair of upper and lower hooks; and a pair of upper and lower connecting links, mounted between the double-armed pivot and the pair of upper and lower hooks. Upper and lower connecting links are different, to accommodate the cylindrical body, in all the positions of the hooks. The upper connecting link can partially wrap around, the cylindrical body. The lower connecting link can partially wrap around, the cylindrical body.

1 Claim, 6 Drawing Sheets

MORTISE LOCK

BACKGROUND OF THE INVENTION

1. Field of the Invention

The present invention relates in general to locks for sliding doors and, more particularly, to a mortise lock for latching a door to a jamb using a pair of opposing hooks.

2. Description of the Prior Art

In order to improve the latch security, so-called multi-point latches have been developed and used, so that more than one latching element engage the striker plate attached to a jam to provide a more secure arrangement against forced entry.

Attempts have been made in the past to introduce a better mortise lock. U.S. Pat. No. 5,951,068, dated Sep. 14, 1999 and granted to Strong et al. for a "Lock for Sliding Door", discloses a lock for a sliding closure. The lock includes a housing with a pair of hook shaped locking elements, the latter being mounted for rotation within the housing. A handle is coupled to a gear wheel that meshes with a pair of rack elements, located for sliding movement in the housing. A projection from each rack element engages in a curved slot of the locking element. Consequently, rotation of the handle results in a sliding movement of each of the racks, which causes the locking elements to move between a retracted first position, where the locking elements are retracted in the housing, and a second position where the locking elements can engage a strike plate. There is a main disadvantage to this lock. The main components, such as gear wheel, rack elements and housing are relatively difficult to manufacture and, therefore, costly. Another disadvantage is believed to reside in the oversized components, apparently to withstand high tensions usually not present in this type of lock. Also the anti slam system employed by the lock does not allow the hooks to be pushed back into the lock in case of the door being slammed while the hooks are deployed. U.S. Pat. No. 5,820,170, dated Oct. 13, 1998 and granted to Clancy for a "Multi-Point Sliding Door Latch" describes a mortise lock. The latter includes an actuator assembly with upper and lower actuators, a gang link, an upper link and a lower link. In its latch design, Clancy's structure has a number of shortcomings. First, the door latch is not compact. Second, use is made of two actuators, each accomplishing the same function. Third, some components, such as the actuators, are complicated and necessitate, comparatively, more expansive technological operations. Lastly, the lock does not employ any form of anti slam mechanism.

SUMMARY OF THE INVENTION

There is accordingly a need for a mortise lock, which overcomes the disadvantages of the prior art. It is the primary objective of the present invention to provide a well-engineered mortise lock that is simple, inexpensive and easily adaptable to existing doors. It is another objective of the present invention to provide a reliable lock that comprises components that generally wear evenly.

It is yet another objective of the present invention to develop a mortise lock that is provided with an efficient anti-slam device, so that no damage can occur when the door, with the hooking assemblies in a protruded state, is slammed shut. Broadly stated, the mortise lock, according to the present invention, is directed to an elongated flat housing assembly, which encases the following components:

- a pair of upper and lower hook assemblies, vertically spaced and mounted for simultaneous counter-rotational movements between an unlatched position with upper and lower hook assemblies retracted within the elongated flat housing assembly and a latched position with the upper and lower hook assemblies extending outwardly from the elongated flat housing assembly
- a pair of upper and lower adjusting assemblies, vertically spaced and generally located in parallel with the pair of upper and lower hook assemblies and used for conveniently positioning the latter within elongated flat housing assembly
- an actuating assembly including:
  - a double-armed pivot having a cylindrical body and a pair of opposed extending arms, disposed between the pair of upper and lower hook assemblies and adapted to be operated by a handle or alike
  - a pair of upper and lower connecting links, mounted between the double-armed pivot and the pair of upper and lower hook assemblies.

Upper and lower connection links have different configurations, each being shaped to accommodate the cylindrical body of the double-armed pivot in all the positions of the upper and lower hook assemblies, especially in the retracted position of the latter. Specifically, the upper connecting link is characterized by a first compound curvilinear configuration, so as to partially wrap around, with a sliding contact, the cylindrical body of the double-armed pivot. Conversely, the lower connecting link is characterized by a second compound curvilinear configuration, so as to partially wrap around, with a sliding contact, the cylindrical body of the double-armed pivot.

DESCRIPTION OF THE PREFERRED EMBODIMENT

Figure 1:
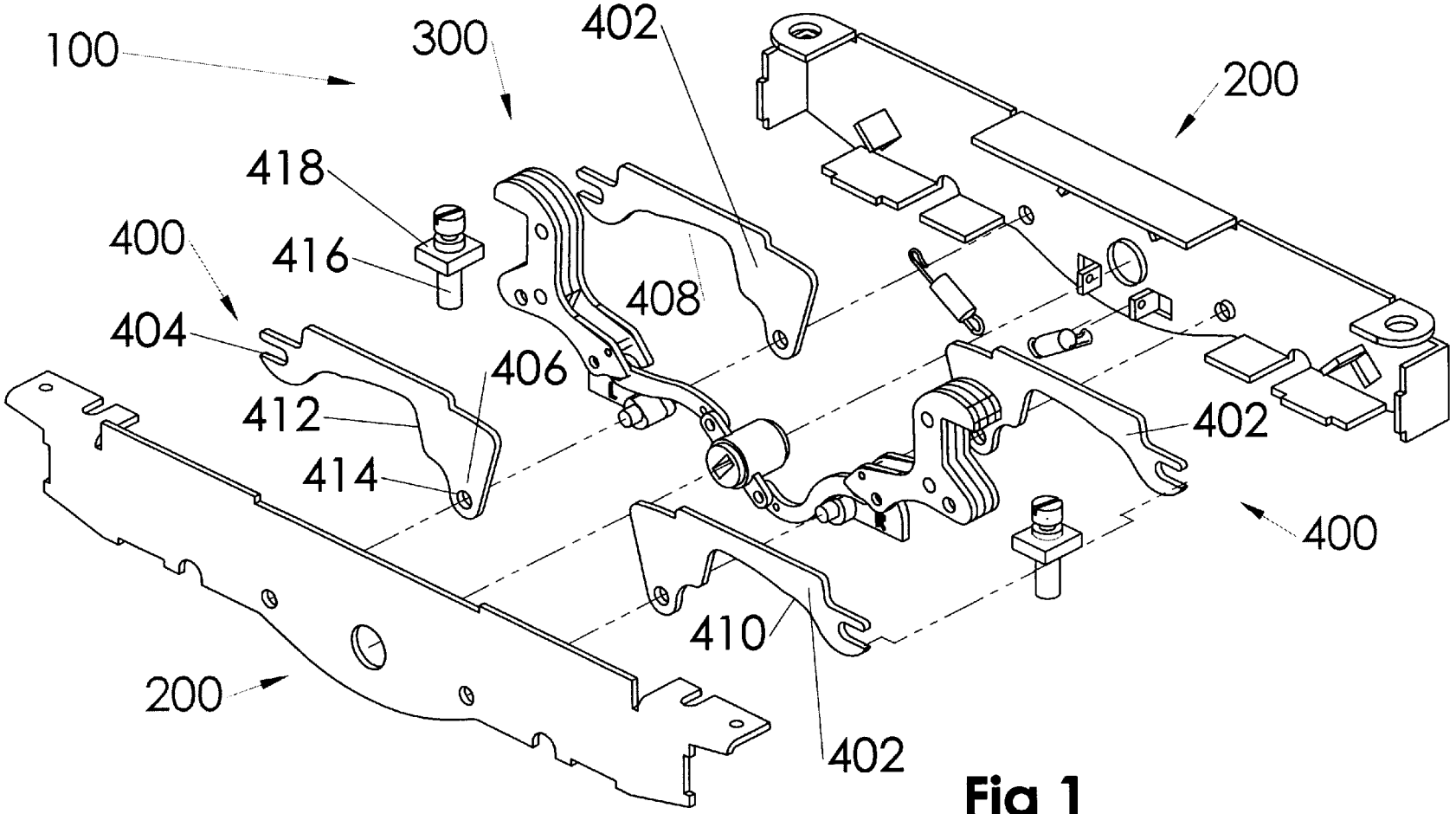
FIG. 1 illustrates an exploded view of the mortise lock of the present invention.
Figure 2:
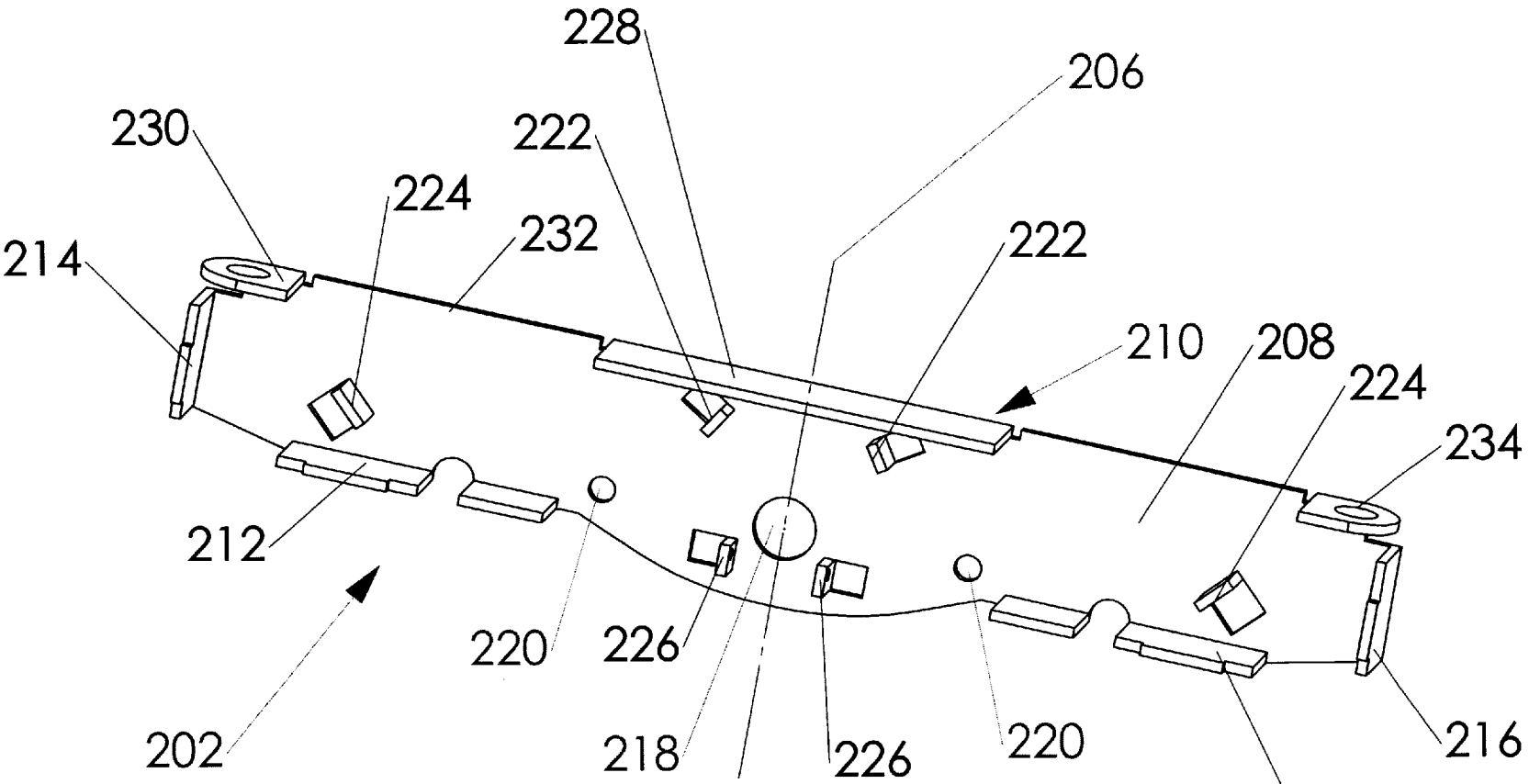
FIG. 2 illustrates a perspective view of the housing of the mortise lock.
Figure 3:
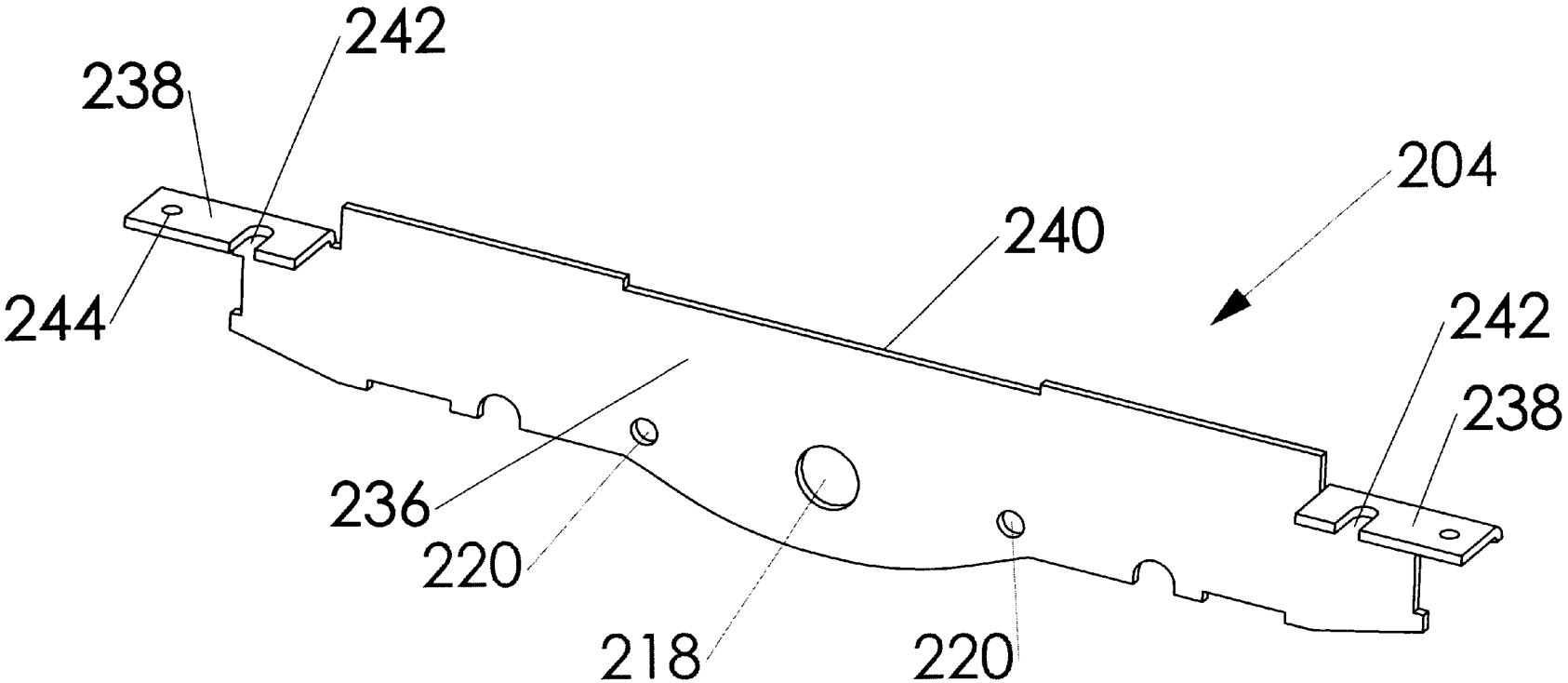
FIG. 3 illustrates a perspective view of the cover of the mortise lock.
Figure 4:
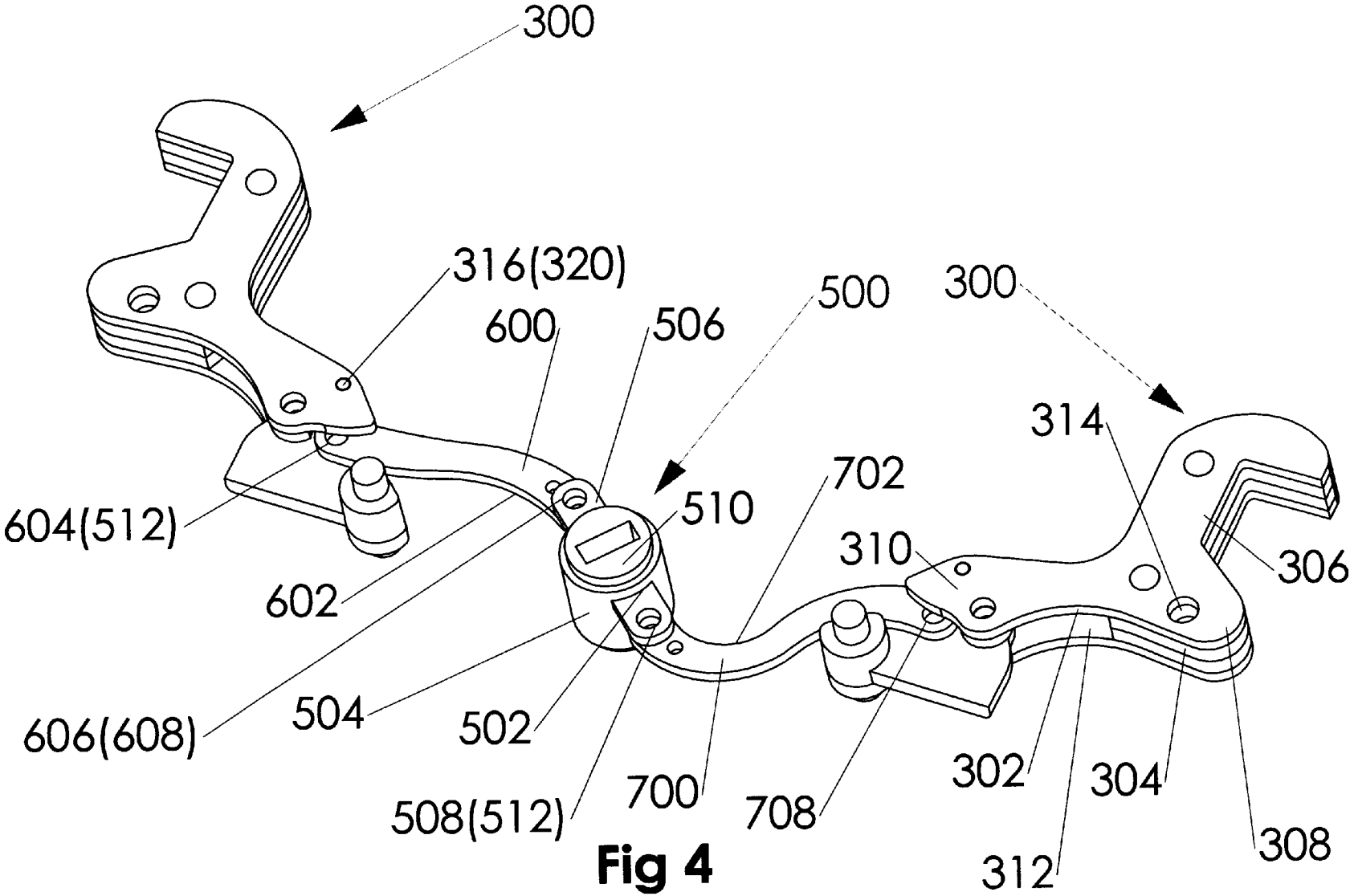
FIG. 4 illustrates a perspective view of the main mechanism of the mortise lock.
Figure 5:
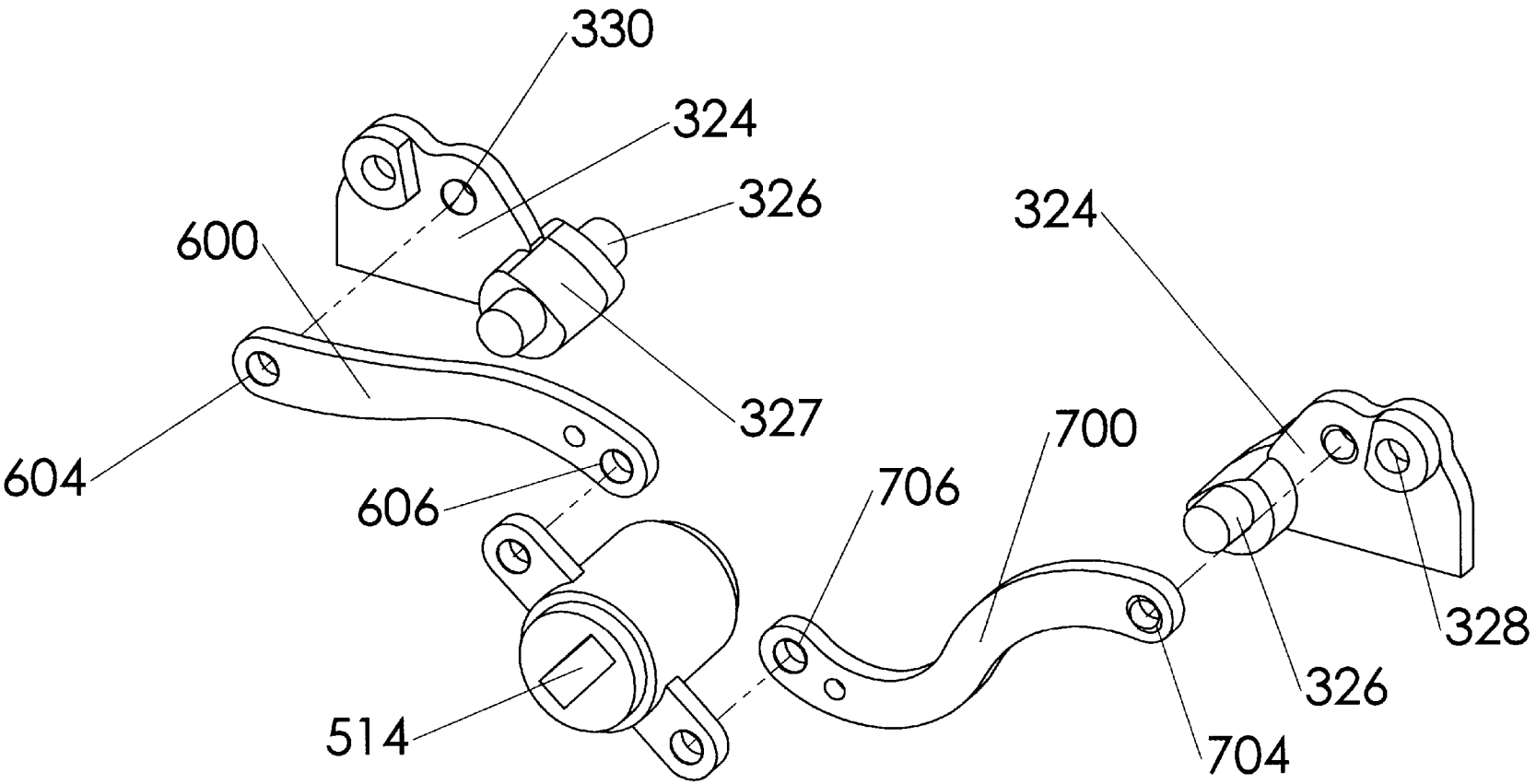
FIG. 5 illustrates an exploded view of the main mechanism without the upper and lower hook assemblies.
Figure 6:
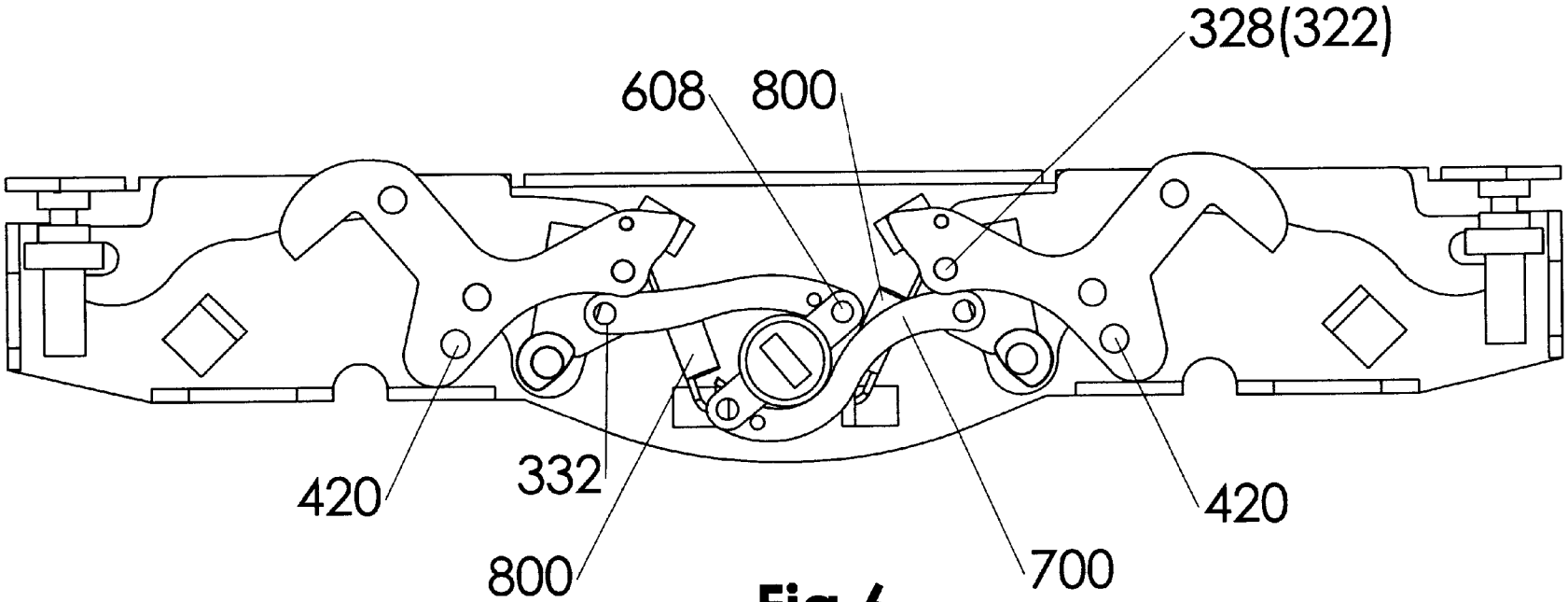
FIG. 6 illustrates front schematic view of the mortise lock without the cover.

A mortise lock 100 is shown in FIG. 1.

It is to be agreed, that terms such as "upper", "lower", "inward", "outward", "rearward", "front", "back", "side", "top", "bottom", "left" and "right" are conventionally used in the present specification with reference to the normal position in which mortise lock 100 would be used.

Broadly described, mortise lock 100 comprises:

- an elongated flat housing assembly 200 encasing
- a pair of upper and lower hook assemblies 300, vertically spaced and mounted for simultaneous counter-rotational movements between an unlatched position with upper and lower hook assemblies 300 retracted within the elongated flat hosing assembly and a latched position with upper and lower hook assemblies 300 extending outwardly from elongated flat housing assembly 200 a pair of upper and lower adjusting assemblies 400, vertically spaced and generally located in parallel with the pair of upper and lower hook assemblies 300 and used for conveniently positioning the latter within elongated flat housing assembly 200 an actuating assembly 500 including:

a double-armed pivot 502 having a cylindrical body 504 and a pair of opposed radially extending arms 506, disposed between the pair of upper and lower hook assemblies and adapted to be operated by a handle or alike a pair of upper and lower connecting links 600 and 700, respectively, mounted between double-armed pivot 502 and pair of upper and lower hook assemblies 300.

The following describes in detail, with reference to FIGS. 1 to 6, the components of mortise lock 100. Elongated flat housing assembly 200 includes a housing 202 and a cover 204, the former and the latter being formed in a stamping operation and made to be snapped together. Housing 202 (see FIG.2) is defined by a transversal axis of symmetry 206 and incorporates a side basic wall 208 extending into front and back walls 210 and 212, and top and bottom walls 214 and 216, respectively.

Side basic wall 208 contains a central opening 218, situated on transversal axis of symmetry 206, and a pair of aligning openings 220, spaced vertically at each side of central opening 218 and generally positioned on a vertical line passing through the center of the latter. A pair of first lugs 222, struck from side basic wall 208, is vertically spaced somewhat above and below transversal axis of symmetry 206, and close to front wall 210 and inclined with respect to the above axis.

A pair of second cam lugs 224, struck from side basic wall 208, is also vertically spaced and inclined with respect to transversal axis of symmetry 206 and situated proximate to back wall 212 and top and bottom walls 214 and 216, respectively.

A pair of third lugs 226, struck from side basic wall 208, is vertically spaced somewhat above and below transversal axis of symmetry 206 and located rearward with respect to central opening 218.

Front wall 210 includes a central portion 228 and a pair of end portions 230. A pair of rectangular apertures 232 is disposed between the former and the latter. Each end portion 230 is provided with a hole 234.

Cover 204 (see FIG.3) has a main wall 236 containing a central opening 218 and a pair of aligning openings 220, the former and the latter being equal in size and axially coincidental with the same openings formed in side basic wall 208.

Main wall 236 has a pair of cranked portions 238 and a frontal cut-off 240. The latter is intended to engage front wall 210. Each cranked portion 238 is provided with a slot 242 corresponding to hole 234 and a threaded aperture 244 adapted for securing mortise lock 100 to a door. Cranked portions 236, when elongated flat housing 200 is assembled, superpose end portions 228.

Each upper and lower hook assemblies 300 (see FIG.4) includes two long exterior hook plates 302 and two short interior hook plates 304, the latter being sandwiched between the former. Long exterior hook plates 302 and short interior hook plates 304, superimposed as described above, are firmly secured by riveting.

Long exterior hook plate 302 has an outwardly extending hook portion 306, a middle portion 308 and an inwardly extending connecting portion 310, located proximately to transversal axis of symmetry 206. Between outwardly extending hook portion 306 and middle portion 308, a grooved portion 312 is situated.

Short interior hook plate 304 is basically configured to correspond in shape to a combination of outwardly extending hook portion 306 and middle portion 308.

Middle portion 308 is provided with a transversal aperture 314, while inwardly extending connection portion 310 incorporates an external and internal openings 316 and 318, respectively. A spring attachment pin 320 is firmly secured in external opening 316, while a pivotable spigot 322 is inserted in internal opening 318.

A pair of connecting arms 324, wherein each is the mirror image of the other one, both being directed towards transversal axis of symmetry 206, is articulated respectively to upper and lower hook assemblies 300. Connecting arm 324 has, axially, on both sides, a cylindrical extension 326 to be inserted in two opposed aligning openings 220, one in side basic wall, the other one in main wall 236. Furthermore, connecting arm 324 includes a lateral flat surface 327. Aligning openings 220 serve as bearings for cylindrical extensions 326. Each connecting arm 324 is also provided with a first and second connecting openings 328 and 330, respectively. First connection opening 328 is located at an extremity of connecting arm 324, while second connection opening 330 is located between the latter and cylindrical extensions 326.

Pivotable spigot 322, inserted in internal openings 318, traverses first connecting opening 328. Thus, connecting arm 324, which is situated between inwardly extending connection portions 310 of a pair of long extending hook plates 302, can pivot.

A pivoting pin 332 is inserted in second connection opening 330.

The pair of upper and lower connecting links 600 and 700, respectively, interrelates upper and lower hook assemblies 300, via the pair of connecting arms 324, with double-armed pivot 502.

Upper connecting link 600 is defined by a first compound curvilinear configuration 602, so as to conveniently wrap partially around, with a sliding contact, double-armed pivot 502, respectively its cylindrical body 504.

Lower connecting link 700 is defined by a second compound curvilinear configuration 702, so as to conveniently wrap partially around, with a sliding contact, double-armed pivot 502, respectively its cylindrical body 504.

Upper and lower connecting links 600 and 700, respectively, are each provided, close to their extremities by an upper proximate and remote openings 604 and 606 and, respectively by a lower proximate and remote openings 704 and 706.

A proximate upper linking pin 608 and a proximate lower linking pin 708 are inserted in remote openings 606 and 706, respectively, for pivotally attaching upper and lower connecting links 600 and 700, respectively, to connecting arms 324, while upper remote openings 606 and lower remote openings 706, respectively, are used for pivotally attaching to double-armed pivot 502. The latter has, as stated before, cylindrical body 504 and the pair of opposed, radially extending arms 506. Each arm 506 is provided with an arm aperture 508.

Cylindrical body 504 ends at both extremities with a guide end 510, which, comparatively with the former, is of lesser diameter and reduced length. Guide ends 508 are respectively inserted in center openings 218 of side basic wall 208 and main wall 236.

A hinge pin 512 is inserted into upper proximate opening 604, respectively lower proximate opening 704 and arm aperture 508. Thus, upper and lower connecting links 600 and 700, respectively, and connecting arms 324 are interrelated.

Double-armed pivot 502 incorporates a slotted hole 514 adapted for fitting a knob or handle for actuating mortise lock 100.

Upper and lower adjusting assemblies 400 are identical and each comprises right and left adjusting arms 402. Each right and left adjusting arm 402 incorporates an outwardly extending bifurcated end 404 and an inwardly extending aperture end 406. Between the former and latter there is indented zone 408 with a cam edge 410 and a sloped edge 412. Inwardly extending aperture end 406 includes an end aperture 414. Right and left adjusting arms 402 flank upper and lower hook assemblies 300, so that cylindrical extensions 326 of each connecting arm 324 traverse end apertures 414 of right and left adjusting arms 402 and then penetrate into aligning openings 220. Thus, right and left adjusting arms 402 can rotate.

One adjusting bolt 416 passes through hole 234 of end portion 230 and slot 242 and is threaded into a nut 418. The latter is received in outwardly extending bifurcated ends 404 of left and right adjusting arms 402. By turning adjusting bolt 416, nut 418 is displaced forwardly or rearward, so that left and right adjusting arms 402 are forced to simultaneously pivot.

A pivot pin 420 is inserted into transversal aperture 314 of middle portion 308 of long exterior hook plate 302 and extends beyond upper and lower hook assemblies 300, respectively, to engage by sliding side basic wall 208 and main wall 236. The position of each cam edge 410, settled by adjusting bolt 414, conveniently determines the movements of upper and lower hook assemblies 300, respectively, so that a functional correlation with respect to an exterior strike plate (not shown), used in connection with mortise lock 100, is established.

A pair of helical tension springs 800 of the type with a round hook at each end is used. Each helical tension spring 800 is joined to a third slug 226 and a spring attachment pin 320.

Operation of Mortise Lock 100

Actuating assembly 500 operates in response to the rotation of a tail element from a handle (both not shown), inserted into double-armed pivot 502, respectively into its slotted hole 514.

As a result:

upper connecting link 600, pivotally joined to one of the opposed, radially extending arms 506 of double-armed pivot 502, acts on one connecting arm 324, which is articulated to upper hook assembly 300; thus, the latter is forced to move in a clockwise direction from its unlatched position to its latched position, whereas lower connecting link 700, pivotally connected to another of the opposed, radially extending arms 506 of double-armed pivot 502, which is articulated to lower hook assembly 300, causes the latter to move from its unlatched position in a counter-clockwise direction.

Upper and lower connecting links 600 and 700, as stated before, have different configurations. Each of these configurations is shaped to accommodate cylindrical body 504 of double-armed pivot 502, when upper and lower hook assemblies 300 change their positions, especially in the retracted position.

Connecting arm 324, which is disposed beneath transversal axis of symmetry 206, can accommodate, due to its lateral flat surface 327, lower connecting link 700 (when upper and lower hook assemblies 300 are in the extended position).

For technological simplification, both connecting arms 324 are similar (one being the mirror image of the other one). In reality, connecting arm 324, which is disposed above transversal axis of symmetry 206, does not require a lateral flat surface 327.

In order to obtain an appropriate position of upper and lower hook assemblies 300, the latter are pivoted with respect to cylindrical extensions 326 by rotating adjusting bolt 416. The engagement of pivot pin 420 with cam edges 410 determines the position of outwardly extending hook portion 306.

The pair of helical tension springs 800 is biasing upper and lower hook assemblies 300 to latching position as well as resiliently maintaining mortise lock 100 in retracted, unlatched position.

For protection of mortise lock 100 against damage when the door is slammed shut with outwardly extending hook portions 306 in a protruded state, out of rectangular apertures 232 of front wall 210, use is made of second cam lugs 224. The latter are so disposed and shaped, so as the door moves to the closed position, outwardly extending hook portions 306 engage a striker plate (between its apertures), such that continued closing movement of the door causes middle portion 308 of long exterior hook plates 302 (together with corresponding portions of the pair of short interior hook plates 304) to contact second cam lugs 224 and slide on them. Thus, upper and lower hook assemblies 300 are urged in a sliding movement that forces them to collapse in an inward and retracted position.

Second cam lugs 224, interacting with middle portions 308, allow the latching operation to be initiated and occur only when mortise lock 100 is unlatched and the door is closed; otherwise an anti-slam protection is provided.

In the retracted position of mortise lock 100, the engagement of inwardly extending connection portions 310, situated between right and left adjusting arms 402, with the pair of first lugs 222 causes a retractile movement of upper and lower hook assemblies 300 within elongated flat housing assembly 200.

When outwardly extending hook portions 306 are retracted, the latter can be extended only upon handle or knob actuation of double-armed pivot 502, since only separation of inwardly extending connection portions 310 from pivot pin 420 will allow the pair of helical tension springs 800 to bias the upper and lower hook assemblies 300 to an extended position.

For retraction of upper and lower hook assemblies 300, double-armed pivot 502 is driven by a handle or knob, which causes those assemblies to move toward transversal axis of symmetry 206. This movement is guided by an engagement of pivot pins 420 with cam edges 410. Then, an inward movement takes place as pivot pins 420 ride sloped edges 412 of right and left adjusting arms 402. This inward movement is continued toward a full inward position as inwardly extending connection portions 310 encounter the pair of first lugs 222.

The pair of second lugs 224 does not participate in a normal retraction of upper and lower hook assemblies 300. The pair of second lugs 224 is involved only if upper and lower hook assemblies 300 are in an extended position and struck by a contact with a striker plate when the door is advanced toward the latter.

As required, a detailed embodiment of the present invention is disclosed herein; however, it is to be understood that the disclosed embodiment is merely exemplary of the invention, which may be embodied in various forms. Therefore, specific structural and functional details disclosed therein are not to be interpreted as limiting, but merely as a basis for the claims and as a representative basis for teaching one skilled in the art to variously employ the present invention in virtually any appropriately detailed structure.

The embodiments of the invention in which an exclusive property or privilege is claimed are defined as follows:

1. Mortise lock comprising means for housing encasing a pair of upper and lower hooking means, vertically spaced and mounted for simultaneous counter-rotational movements between an unlatched position, with said pair of upper and lower hooking means retracted within said means for housing, and a latched position, with said pair of upper and lower hooking means extending outwardly from said means for housing;

a pair of upper and lower adjusting means, vertically spaced and generally located in parallel with said pair of upper and lower hooking means and used for conveniently pivoting said pair of upper and lower hooking means within said means for housing;

an actuating means including a double-armed pivoting means having a cylindrical body and a pair of opposed radially extending arms disposed between said pair of upper and lower hooking means and adapted to be operated by a handle; and a pair of upper and lower connecting links, mounted between said double-armed pivoting means and said pair of upper and lower hooking means, said pair of upper and lower connecting links having different configurations, each being-provided with means for accommodating with said double-armed pivoting means, respectively with said cylindrical body, in any position of said pair of upper and lower hooking means, especially in retracted positions of said pair of upper and lower hooking means.

* * * * *